United States Patent [19]

Forsell et al.

[11] Patent Number: 4,520,244

[45] Date of Patent: May 28, 1985

[54] CONSTANT LOAD SNAP SWITCH WITH MANUAL OR AUTOMATIC RESET, STOP AND TEST SELECTION

[75] Inventors: Kenneth A. Forsell, Whitefish Bay; Edward A. Mallonen, New Berlin, both of Wis.

[73] Assignee: Eaton Corporation, Cleveland, Ohio

[21] Appl. No.: 453,208

[22] Filed: Dec. 27, 1982

[51] Int. Cl.[3] ..... H01H 5/22

[52] U.S. Cl. ..... 200/67 DA; 200/67 E; 335/176

[58] Field of Search ..... 200/67 DA, 67 E, 67 R, 200/153 V, 67 D, 71, 72 R, 68 D; 335/176, 188; 337/72

[56] References Cited

U.S. PATENT DOCUMENTS

| | | | |
|---|---|---|---|
| 2,236,680 | 4/1941 | Fry | 200/47 |
| 2,693,520 | 11/1954 | Bruno | 200/153 J |
| 2,708,371 | 5/1955 | Pashby | 200/153 J |
| 2,767,270 | 10/1956 | Perkins | 200/67 E |
| 2,971,069 | 2/1961 | Good | 200/72 A |
| 3,243,548 | 3/1966 | Kjellman et al. | 200/67 |
| 3,383,235 | 9/1974 | Hoshioka | 200/67 DA |
| 3,828,151 | 8/1974 | Brunnell et al. | 200/67 DA |
| 4,211,907 | 7/1980 | Troebel | 335/176 |
| 4,286,132 | 8/1981 | Greenwald | 200/67 D |
| 4,295,017 | 10/1981 | Kashima et al. | 200/153 T |

FOREIGN PATENT DOCUMENTS

| | | | |
|---|---|---|---|
| 2707794 | 12/1977 | Fed. Rep. of Germany | 200/67 DA |

*Primary Examiner*—Stephen Marcus
*Assistant Examiner*—Renee S. Kidorf
*Attorney, Agent, or Firm*—C. H. Grace; W. A. Autio

[57] ABSTRACT

A constant load and constant contact force snap-action switch having a normally-closed movable operate contact on a flipper blade which has a compression strip that snaps through an S-curvature to a reverse buckled state to trip the operate contact open. The flipper blade is coupled through an insulating cap to the leaf spring mounted movable alarm contact to close the latter at the same time. A return spring biased reset lever resets the operate contacts on depression down a first amount, opens the operate contact without closing the alarm contacts on depression down a second amount for stop purposes, and trips the operate contacts open on lifting upwards for test purposes. On reset, lost motion in the coupling cap knocks the alarm contact open if welded. A selector is settable to select any of three functions for the reset lever, (1) reset-stop-test, (2) auto reset stop, or (3) reset test.

15 Claims, 22 Drawing Figures

Fig. 3
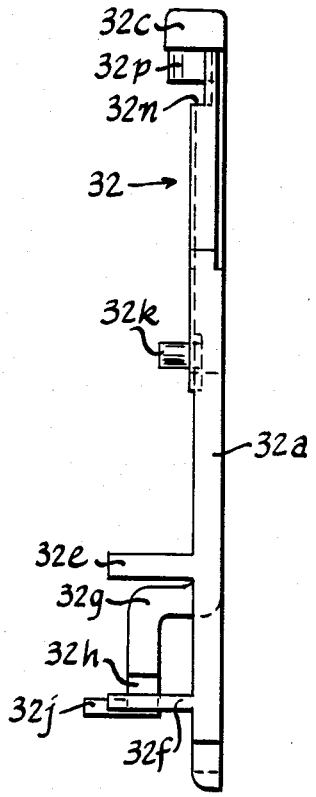
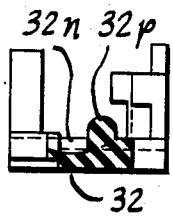
Fig. 4
Fig. 2
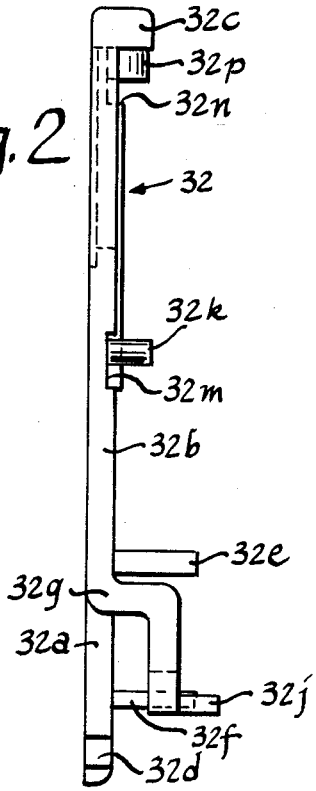
Fig. 9
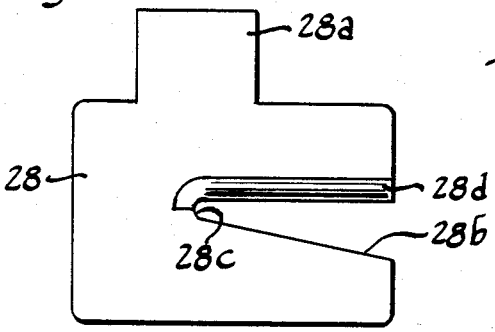
Fig. 10
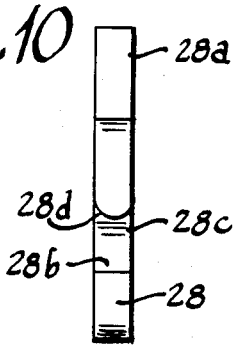

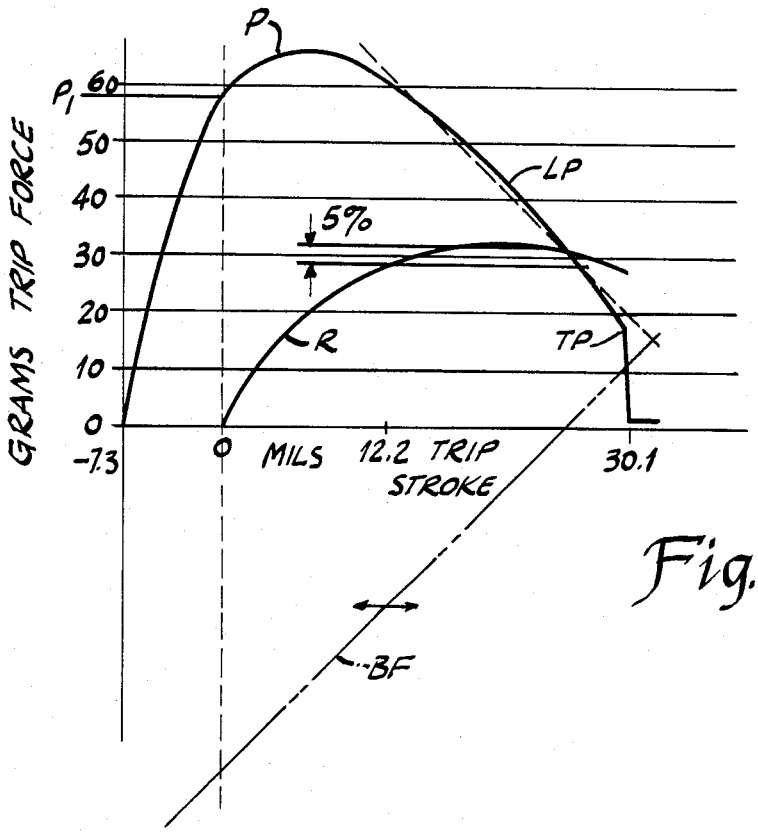
Fig. 18
Fig. 19
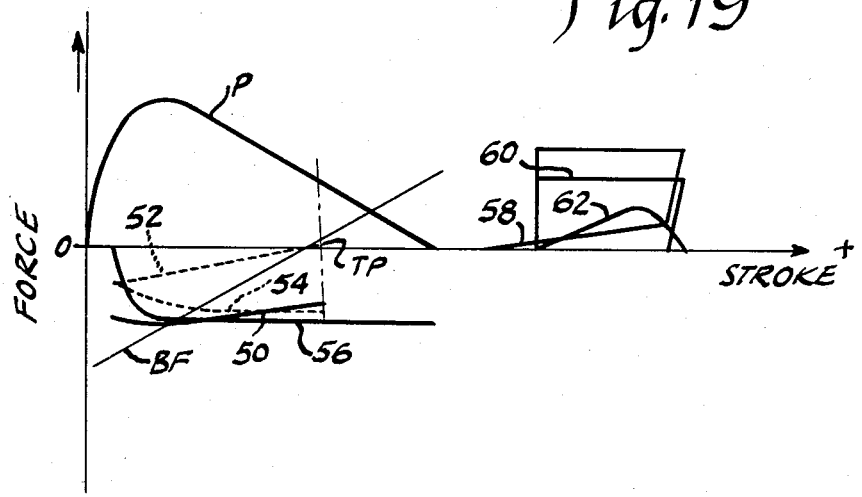

CONSTANT LOAD SNAP SWITCH WITH MANUAL OR AUTOMATIC RESET, STOP AND TEST SELECTION

BACKGROUND OF THE INVENTION

Constant load snap switches have been known heretofor. For example, T. K. Kjellman et al U.S. Pat. No. 3,243,548, dated Mar. 29, 1966, shows a constant actuating force control switch with contact weld breaking means that uses a single switch blade having two flexible tongues cut therefrom and a pair of stationary abutments against which the respective tongues are pivoted and biased. The bias forces of these tongues are arranged with respect to the restraining force of the contact blade such that the actuating force that must be applied to the contact blade to trip the contacts open remains substantially constant. Also, H. Hoshioka U.S. Pat. No. 3,838,237, dated Sept. 24, 1974, shows a light load type pushbutton switch that has an actuator spring design so that when it is used in connection with a turning or toggle spring, the resultant pushbutton operating load remains substantially constant to the tripping point but the pressure on the normally closed contacts decreases rapidly to zero value before the switch trips. Such decreasing contact force, of course, has the disadvantage that it results in teasing and possible burning or welding of the contacts and consequent malfunction. Conventional switches of the aforementioned type have also been handicapped by the fact that they have not been generally adaptable to a variety of functions. This invention relates to improvements thereover.

SUMMARY OF THE INVENTION

An object of the invention is to provide an improved constant load snap switch with manual or automatic reset, stop and test selection.

A more specific object of the invention is to provide an improved constant load 4-terminal snap switch of the aforementioned type having normally closed operate contacts and isolated normally open alarm contacts.

Another specific object of the invention is to provide a constant load snap switch of the aforementioned type with means providing constant contact force up to the trip point.

Another specific object of the invention is to provide a snap switch of the aforementioned type with constant trip loading characteristics over a large portion of the trip stroke ahead of and near the trip point.

Another specific object of the invention is to provide a snap switch of the aforementioned type that requires less work to trip thereby affording use of a lower power actuator.

Another specific object of the invention is to provide a constant load and constant contact force snap switch of the aforementioned type that is more stable under shock and vibration conditions.

Another specific object of the invention is to provide a constant load snap switch of the aforementioned type wherein the sensitivity near the trip point, which is extremely critical for a conventional unbiased flipper spring, is greatly improved.

Another specific object of the invention is to provide a constant load and constant force snap switch of the aforementioned type wherein teasibility is greatly reduced.

Another specific object of the invention is to provide a constant load snap switch of the aforementioned type that is readily adaptable to a variety of functions.

Other objects and advantages of the invention will hereinafter appear.

BRIEF DESCRIPTION OF THE DRAWINGS

FIG. 2 is a reduced right side elevational view of the reset lever of the switch of FIG. 1;

FIG. 3 is a reduced left side elevational view of the reset lever of the switch of FIG. 1;

FIG. 4 is a cross-sectional view of the reset lever taken substantially along line 4—4 of FIG. 1;

FIG. 9 is an enlarged bottom view, turned 90° counterclockwise, of the trip link of the switch of FIG. 1;

FIG. 10 is a right side view of the trip link of FIG. 9;

FIG. 18 is a graph depicting switch operating characteristic curves of the snap switch of FIG. 1; and FIG. 19 is a work diagram showing further trip and reset operating characteristics of the switch of FIG. 1.

DESCRIPTION OF THE PREFERRED EMBODIMENT

Figure 1:
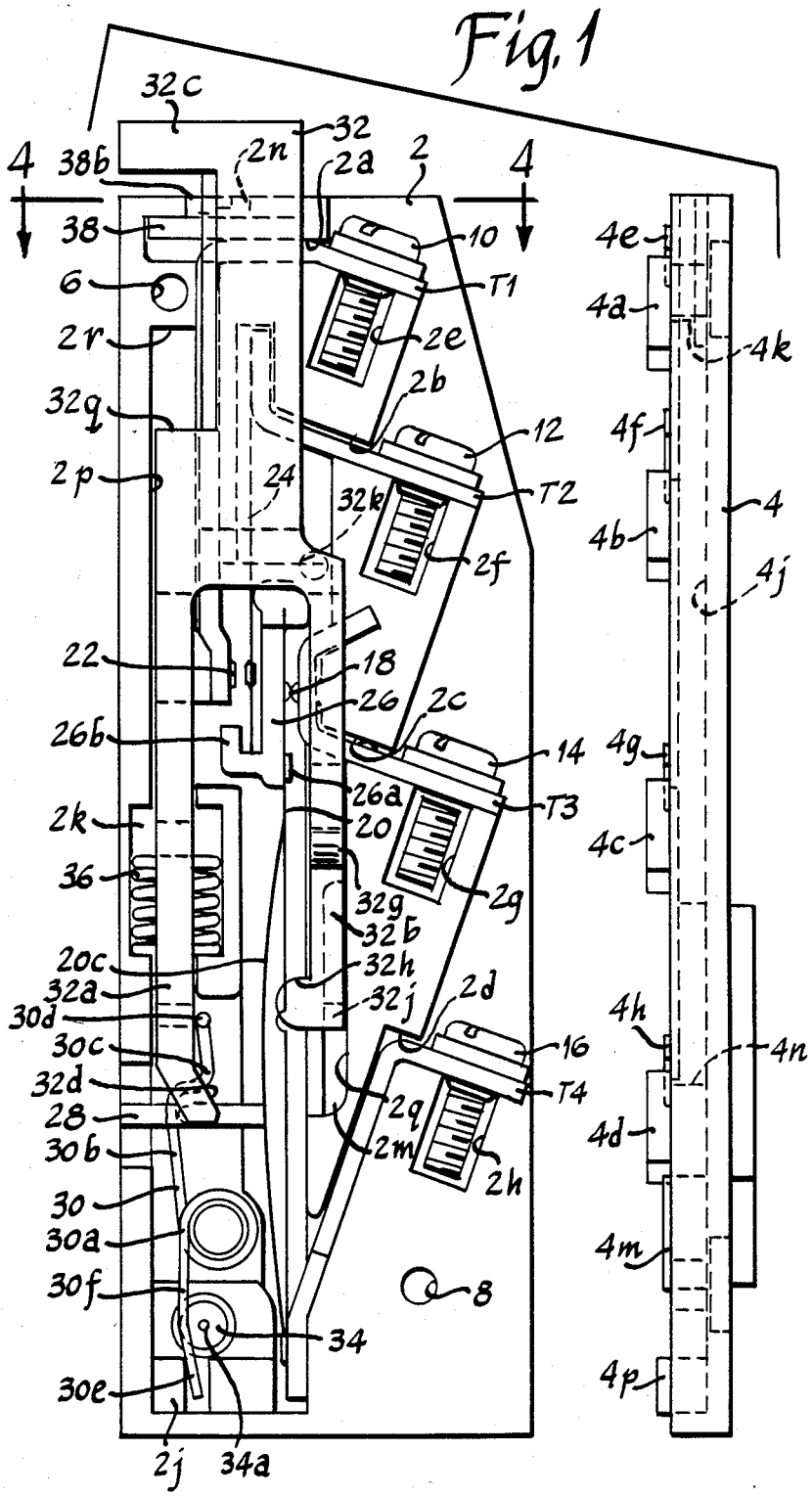
FIG. 1 is an enlarged front elevational view with the cover removed of a constant load snap switch with manual or automatic reset, stop and test selection constructed in accordance with the invention.

Referring to FIG. 1, there is shown a constant load snap switch with manual or automatic reset and stop and test selection constructed in accordance with the invention. As shown therein, the switch is provided with a housing including an insulating molded base 2 and a cover 4 normally secured to the base of a pair of screws or rivets through holes 6 and 8 but which has been removed in FIG. 1 to show the switch mechanism mounted within the base. The base is provided with four slots 2*a*, 2*b*, 2*c* and 2*d* for receiving and securely retaining four switch terminals T1, T2, T3 and T4, respectively. In normal use of the switch, terminals T1 and T2 connect normally-open contacts in an alarm circuit while terminals T3 and T4 connect normally-closed contacts in an operate circuit such as the operating coil circuit of a contactor or the like. The base is also provided with four slots 2*e*, 2*f*, 2*g*, and 2*h* for receiving and providing clearance for four terminal screws 10, 12, 14 and 16, respectively.

Figure 5:
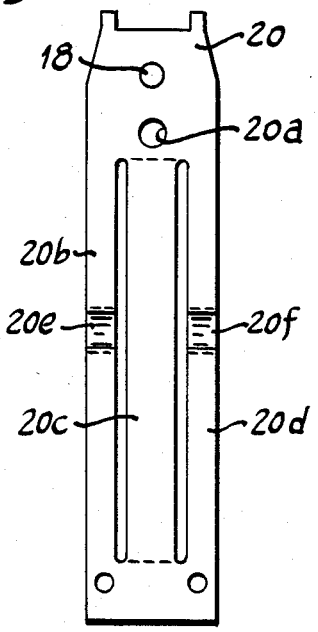
FIG. 5 is a reduced right side elevational view of the flipper spring of the switch of FIG. 1.

The normally closed operate contacts 18 which may be of good electrically conducting contact material such as silver or the like are secured to terminal T3 and the upper end of a main flipper spring or blade 20. The lower end of main flipper spring 20 is riveted to the inner end of terminal T4 as shown in FIG. 1. Normally-open alarm contacts 22 are secured to the inner end of terminal T1 and the lower end portion of a contact blade or leaf spring 24 which is riveted at its upper end to the inner end of terminal T2. A molded plastic insulating member or flipper cap 26 fixed to the upper end of the main flipper spring 20 is arranged to drive closed the movable alarm contact on spring 24 in response to mechanical actuation of the switch. As shown in FIGS. 1 and 5, flipper blade 20 is provided with a hole 20*a* at its upper end portion through which a projection 26*a* of flipper cap 26 extends and is heat formed on the other side of the flipper blade to rigidly secure the flipper cap to the blade.

As shown in FIG. 5, flipper blade 20 has two narrow elongated verticle slots cut thereinto to divide the major portion thereof into three strips including a left strip 20*b*, a center strip 20*c* and a right strip 20*d*, Radii 20*e* and 20*f* are formed slightly above the mid-portions of outer strips 20*b* and 20*d*, these radii being equal and causing tensile loading of the outer strips and compresive loading of the center strip 20*c*. As a result, application of tripping force below the center on compression strip 20*c* causes the compression strip to deflect and reverse buckle as hereinafter described to cause tripping of the switch, thereby opening the normally-closed contacts and closing the normally-open contacts. Flipper cap 26 is provided with a lost motion hook 26*b* at its lower end portion into which the lower end of movable contact spring 24 extends so that if the alarm contacts should stick or weld, upon resetting of the switch, hook 26*b* will apply an impact or a "hammer blow" on the lower end of movable contact spring 24 to insure opening of the alarm contacts.

Figure 11:
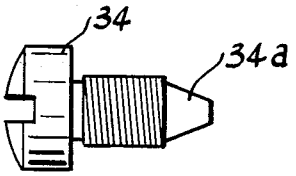
FIG. 11 is a side view of the calibration screw of the switch of FIG. 1.

A trip member or link 28 of insulating molded material as shown in FIGS. 1, 9 and 10 is guided in a horizontal slot in base 2 and has a drive projection 28*a* normally pressed against center strip 20*c* of flipper blade 20 below the center point of center strip 20*c* so that a force applied to this trip link will cause tripping of the switch. Although trip link 28 is shown enlarged in FIGS. 9 and 10, drive projection 28*a* in actuality has a width substantially equal to the width of center strip 20*c* on the flipper blade. Trip link 28 also has a tapered slot 28*b* extending from one edge beyond its midportion as shown in FIG. 9 for receiving the upper end portion of a bias spring 30 as shown in FIG. 1. The lower edge of this slot is angular as shown in FIG. 9, the closed end of this slot is provided with a radius 28*c* to snugly receive the upper end portion of bias spring 30 and the upper horizontal edge of this slot is provided with a rounded configuration 28*d* as shown in FIG. 9 to maintain a point contact with bias spring 30. Bias spring 30 has several turns at its midportion forming a loop 30*a* whereby it is mounted on a cylindrical stud integrally formed in base 2. The upper end portion 30*b* of this bias spring extends up through slot 28*b* of trip link 28 as hereinbefore described and has an offset 30*c* immediately above the trip link and the extreme upper end 30*d* of this bias spring is bent at a right angle forwardly so that it will overlie test leg 32*a* of reset lever 32 for operation by test cam 32*d* of the reset lever. The lower end portion 30*e* of the bias spring extends down into abutment with a stop lug 2*j* integrally molded in the lower end portion of base 2. A calibration screw 34 also shown in FIG. 11 is threaded in the base and has a tapered or conical end 34*a* that bears against the lower stem portion 30*f* of the bias spring between the extreme lower end 30*e* thereof and loop 30*a* as shown in FIG. 1. As will be apparent, rotation of calibration screw 34 in or out causes adjustment of the bias of the upper end portion of the bias spring in the right-hand direction against rounded edge 28*d* of trip link 28 resulting in corresponding adjustment of the force applied by the trip link against flipper blade 20 in the normal unactuated position of the trip link.

Reset lever 32 is provided with the aforementioned left leg 32*a* which is a test leg and also a right leg 32*b* which is a reset leg as shown in FIG. 1. Right, left and cross-sectional view of the reset lever are shown in FIGS. 2, 3 and 4, respectively. Reset lever 32 is provided with a head 32*c* at its upper end which may be manually depressed to reset the switch as hereinafter more fully described and which may be lifted or pulled upwardly by the lateral portion of the head in order to test tripping of the switch as hereinafter more fully described. Lower end portion of test leg 32*a* of the trip lever is provided with an angular portion having an angular cam surface 32*d* that engages right angle end 30*d* of the bias spring when the reset lever is lifted upwardly thereby to trip contacts 18 open for test purposes. This test leg 32*a* of the reset lever is also provided with a pair of spaced rearward projections 32*e* and 32*f* that span the upper and lower ends, respectively, of return spring 36 that is retained in a pocket 2*k* in the base, these projections being more clearly shown in FIGS. 2 and 3.

Figure 6:
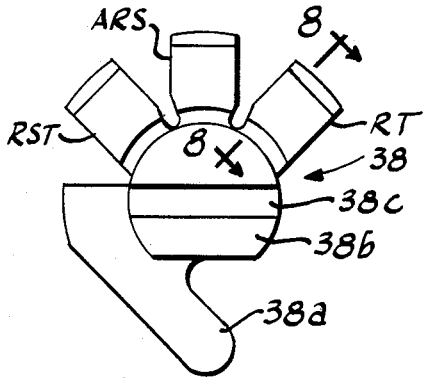
FIG. 6 is an enlarged top view of the selector arm of the switch of FIG. 1.

Since the reset lever is slidingly guided for movement in a slot in the cover of the housing, the lower end portion of reset leg 32*b* is offset rearwardly at 32*g* as shown in FIG. 2 into alignment with center strip 20*c* of the flipper blade. For engaging the center strip 20*c* of the flipper blade for reset purposes, the inner side of the lower end portion of reset leg 32 is provided with a semicylindrical portion or actuator 32*h* as shown in FIG. 1 for engaging center strip 20*c* of the flipper blade. To keep right leg 32*b* of the reset lever in proper alignment as the reset lever is actuated, the lower end of reset leg 32*b* is provided with a rearward projection 32*j* shown in FIG. 2 that slides in a verticle groove 2*m* in the base thereby to keep right leg 32*b* from bending inwardly toward left leg 32*a*. Reset lever 32 is also provided with a cylindrical lug 32*k* projecting from a recess 32*m* near the upper end of reset leg 32*b* which is operable when the reset lever is depressed further below the reset point for engaging the rounded upper right-hand portion of flipper cap 26 to open the normally-closed contacts 18 and thereby perform a stop function hereinafter more fully described. Recess 32*m* in the rear surface of the reset lever is provided for the purpose of affording clearance for the upper end portion of flipper cap 26. Reset lever 32 is also provided near its upper end with a notch providing a shoulder 32*n* that cooperates with a cam 38*a* of a selector arm 38 shown in FIGS. 6, 7 and 8 to hold the reset lever in a partially depressed state thereby to provide an automatic reset function as hereinafter more fully described. Reset lever 32 is further provided with a lug 32*p* near its upper end that stops down against cam 38*a* of selector arm 38 to eliminate the stop function and provide the switch with a reset-test function only, as hereinafter more fully described.

Figure 7:
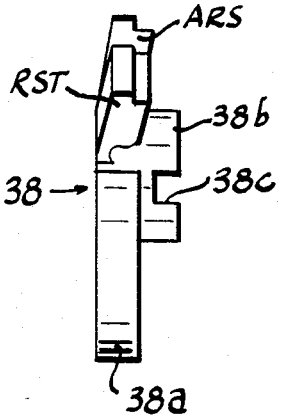
FIG. 7 is a left side view of the selector arm of FIG. 6.
Figure 8:
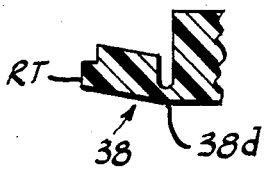
FIG. 8 is a fragmentary cross-sectional view of one of the detents of the selector arm taken substantially along line 8—8 of FIG. 6.

Referring to FIGS. 1 and 6–8, it will be apparent that selector arm 38 has a generally cylindrical center portion 38*b* that is journaled in a substantially round hole 2*n* in the upper wall of the base so that this selector arm rotatably rests on terminal T1. This cylindrical portion 38*b* has a slot 38*c* in the upper end thereof so that the selector arm can be turned by a screwdriver or the like. This selector arm is also provided with three angularly spaced detents RST (reset-stop-test, ARS (auto-reset-stop) and RT (reset-test). These detents are formed so that they are angled slightly upwardly as shown in FIGS. 7 and 8 and are then flattened out as the selector arm is assembled into the switch base so that they are biased upwardly by the integral hinge 38*d* and will snap into a rearward slot on the side of hole 2*n* in the upper wall of the base when the selector arm is turned thereby to retain the selector arm in any one of three selected positions hereinafter described.

Cover 4 for the base is shown at the right-hand portion of FIG. 1. Cover 4 is molded of insulating plastic molding material and is provided with an internal configuration to retain the parts in the base and to provide a slide for the reset lever. As shown in FIG. 1, this cover is provided with four lugs 4*a–d* that enter partway into terminal screw slots 2*e–h* to position the cover on the base. This cover is also provided with four low, rectangular ridges 4*e–h* that abut the exposed edges of the external ends of terminals T1–4 to retain these terminals securely in their slots in the base. The cover is also provided with an elongated channel 4*j* that provides a slide for the reset lever in cooperation with left edge 2*p* at the left-hand side of the base and right edge 2*q* at the right-hand side of groove 2*m* as shown in FIG. 1. The cover is also provided with a stop 4*k* at the upper end of channel 4*j* that is complementary to stop 2*r* in the base for engagement by shoulder 32*q* of the reset lever to limit the upward movement of the reset lever. The cover is also provided with several abutments to hold parts of the switch in place when the cover is assembled on the base including an abutment 4*m* that retains bias spring 30 on its mounting post, an abutment 4*n* that retains trip link 28 in its slot in the base and abutment 4*p* that retains the lower end 30*e* of the bias spring in engagement against lug 2*j* at the lower portion of the base.

Referring to FIG. 1, it will be apparent that application of a trip force to trip link 28 will cause compression member 20*c* of the flipper blade to snap to a reverse buckled state thereby opening operate contacts 18 and closing alarm contacts 22. When the trip force on trip link 28 is relieved, bump 32*h* on reset leg 32*b* of the reset lever will cause compression member 20*c* of the flipper blade to snap back to the state shown in FIG. 1, thereby reopening alarm contacts 22 and reclosing operate contacts 18 to reset the switch, reset lever 32 being shown in FIG. 1 as being in the intermediate depressed autoreset-stop position hereinafter more fully described.

Figure 12A:
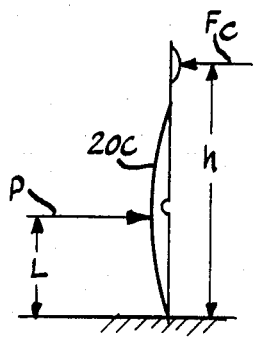
FIGS. 12*a*, 12*b* and 12*c* schematically illustrate three operating positions of the main flipper spring of the switch of FIG. 1 which is also shown in FIG. 5.
Figure 12B:
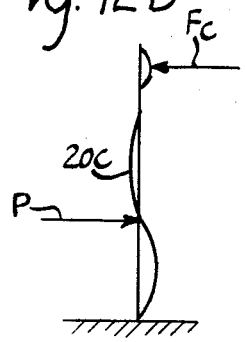
Figure 12C:
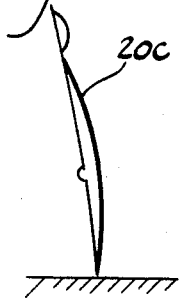

More specifically, referring to FIGS. 12*a*–12*c*, application of tripping force P below center on the compression member as shown in FIG. 12*a* causes the compression member 20*c* to deflect to a characteristic "S" shape as shown in FIG. 12*b* just prior to reaching the tripping point in its motion. Further loading of the compression member 20*c* causes the compression member to trip to the reverse buckled state shown in FIG. 12*c* to trip the operate contacts open and to close the alarm contacts as hereinbefore described.

Figure 13A:
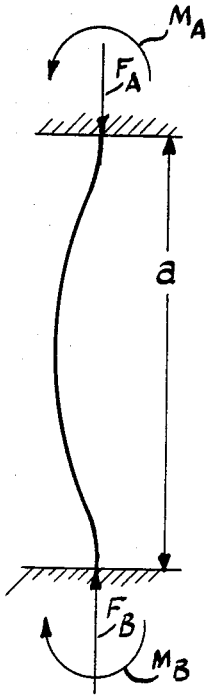
FIGS. 13*a* and 13*b* show two free body diagrams of the compression leg portion of the flipper spring of the switch of FIG. 1.
Figure 13B:
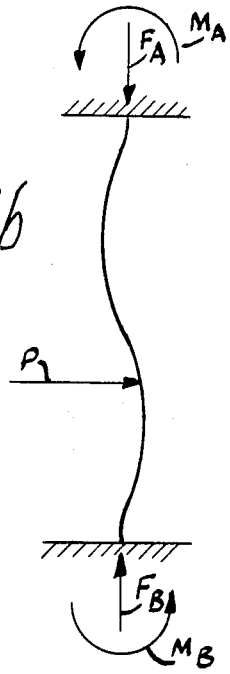

Free body diagrams of the compression member are shown in FIGS. 13*a* and 13*b*. The end restraints for the initial condition illustrated in FIG. 13*a* are equal axial loads FA and −FB and equal mechanical moments MA and −MB. MA is an internal moment and acts to apply contact force, FC, such that $$FC = \frac{MA}{h - a},$$

"h" being shown in FIG. 12*a* and "a" being shown in FIG. 13*a*. As tripping load P is applied and the compression member deflects to the pretripped position shown in FIGS. 12*b* and 13*b*, restraining moment MB reverses direction as shown in FIG. 13*b*. Moment MA, however, does not change direction so that the contact force is not decreased during the tripping stroke. These criteria are satisfied when the tripping load P is applied between the fixed lower end and the midpoint of the compression member. In this configuration, the application of the trip force P is also in a direction to increase contact force FC as shown in FIG. 12*a*. The total expression for the contact force is given by $$FC = \frac{MA}{h - a} + \frac{PL}{h}.$$

The characteristic force P as a function of trip stroke is shown by curve P in FIG. 18. As shown therein, the force P increases rapidly to a peak value and then decreases at a nearly linear rate, tripping just before zero force is reached. The area under this curve P is recognized as the mechanical work required to trip the switch without any bias. A biasing spring 30 may be designed to have a linear spring force BF shown in FIG. 18 that is equal in magnitude but opposite in sign to the substantially linear portion LP of the flipper spring curve P as shown in FIG. 18. If such a bias spring 30, FIG. 1, is oriented such that its free position is near the trip point TP of the flipper spring and the bias spring is designed for positive and negative (push-pull) loading, the resultant switch characteristic will be the algebraic sum of the two load curves P and BF as shown in FIG. 18. This resultant characteristic curve R shown in FIG. 18 is the resultant trip force curve. As shown by the upper portion of curve R in FIG. 18, the load is substantially constant over a large portion of the trip stroke (switch actuating stroke) ahead of and up to trip point TP. The area under the resultant curve R (net switch work) is thus substantially reduced by the bias spring and a lower power actuator may be used. If the switch is to be actuated by a thermal actuator which produces work in linear proportion to its temperature change (i.e., a bimetal) the actuator travel becomes a linear function of temperature and the sensitivity near the trip point, which is extremely critical with a conventional unbiased flipper spring, is greatly improved.

Also, since the toggle-like action is produced by buckling of the compression leg of the main flipper spring, the snap action on trip is very abrupt and the teasibility is greatly reduced in comparison to conventional "over-center" toggle switch operators.

For the above purposes, FIG. 1 shows a coiled torsion spring 30 used as the bias spring where the downwardly extending leg 30*f* is deflected by a tapered lead 34*a* on a calibrating screw 34 also shown in FIG. 11 and the upper leg 30*b* of the torsion spring where it passes through slot 28*b* in the trip link 28 provides the push-pull function through the movable trip link.

Figure 14:
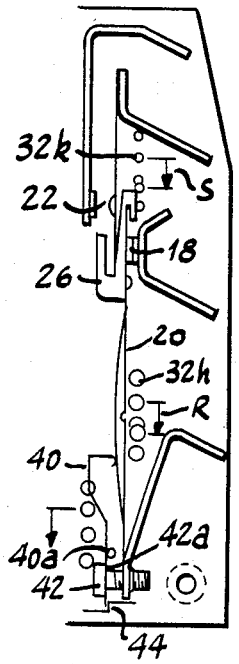
FIG. 14 schematically illustrates the reset function of the reset-test mode of the switch of FIG. 1.
Figure 15:
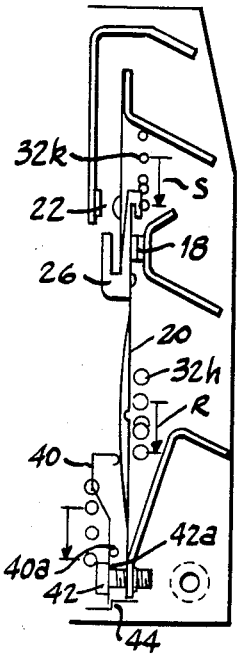
FIG. 15 schematically illustrates the reset and stop functions of the reset-stop-test mode of the switch of FIG. 1.
Figure 16:
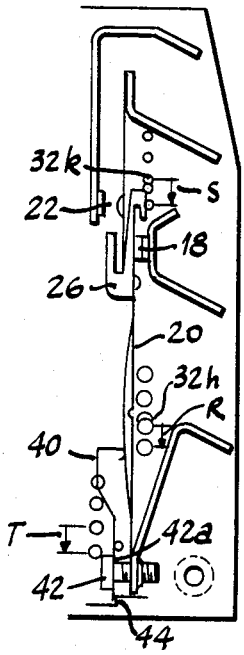
FIG. 16 schematically illustrates the autoreset and stop functions of the autoreset-stop mode of the switch of FIG. 1.
Figure 17:
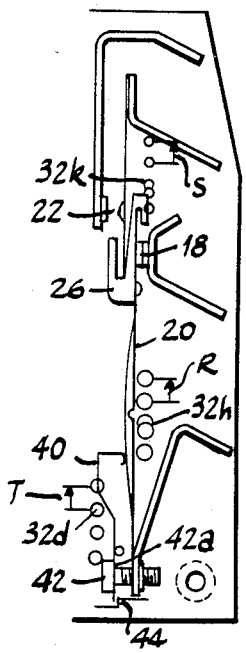
FIG. 17 schematically illustrates the test function of the reset-stop-test mode of the switch of FIG. 1.

An alternative biasing structure is shown in FIG. 14 which includes a flat beam spring 40 whose orientation is adusted through a shoulder 42*a* on a calibrating screw 42. This biasing spring 40 is pivotally mounted at pivot 40*a* and its extreme lower end bears against a stationary abutment 44 so that when the screw is turned the upper end of bias spring 40 applies more or less force against flipper spring 20 when the switch is in the normal position illustrated in FIG. 14. This flat spring 30 is equally capable of providing the "push-pull" function of the bias spring.

Referring again to FIGS. 13*a* and 13*b*, it will be appreciated that the value of the internal axial loading FA doubles in magnitude from the initial state illustrated in FIG. 13*a* to the pretripped state illustrated in FIG. 13*b* roughly in accordance with the buckling loading of redundantly constrained columns. Since this magnitude of the internal axial loading FA contributes directly to the instantaneous value of end moment MA, both moment MA and contact force FC (FIG. 12*a*) tend to be increased by this internal loading change.

Referring to FIG. 19, it will be apparent that the bias force BF which exists at static equilibrium contributes directly to the magnitude of the initial contact force in the last mentioned equation. During application of a switching force, the contact force increases and then decreases slightly as shown by curve 50 in the work diagram of FIG. 19, this curve 50 representing the normally-closed contact force and being the sum of broken line curves 52 and 54 which depict the tripping load and mechanical moment contact force components of the aforementioned equation. In FIG. 19, curve BF is the bias force curve similar to that shown in FIG. 18 and curve P is the flipper blade force similar to that shown in FIG. 18. Curve 56 depicts the trip force and it will be apparent from this curve thaat the trip force is substantially constant. It will also be apparent from the curve 50 that the normally-closed contact force remains substantially constant, decreasing only slightly prior to the trip point TP at which compression member 20*c* trips from its FIG. 12*b* position to its FIG. 12*c* position to open the contacts.

The right-hand portion of the work diagram in FIG. 19 shows the alarm contacts' characteristics. Curve 58 illustrates the alarm contact spring counterforce, curve 60 illustrates the alarm contacts force and curve 62 illustrates the reset force, with the area under curve 62 representing the work required to reset the contacts. From these curves and particularly curve 60 it will be apparent that the alarm contacts force remains substantially constant until the flipper blade toggles back to the normal set position of the switch. At that point the alarm contacts spring counterforce and the reset force both drop to zero.

FIGS. 14–17 illustrate the various manual resetting, testing and stop functions and the automatic resetting function which are selectable by indexing cam 38*a* of selector arm 38 to variously engage the reset lever. When selector arm 38 is turned so that detent RST is in the slot in the upper wall of the base, the reset-stop-test function illustrated in FIG. 15 has been selected. In this position of the selector arm, cam 38*a* is completely free of the reset lever. Consequently, the reset lever may be depressed a first amount to reset the contacts as indicated by arrow R in FIG. 15. During this reset function, bump 32*h* of reset arm 32*b* slides down and depresses compression strip 20*c* of the flipper blade to reset the contacts. The stop function is performed by an additional downward depression of the reset lever after resetting to cause lug 32*k* to engage the upper right-hand curved edge of flipper cap 26 sufficiently to move it over and cause the normally closed contacts 18 to open but not enough to cause the alarm contacts 22 to close. By so opening the normally-closed contacts, whatever is being energized therethrough is stopped. This stop function is illustrated by arrow S in FIG. 15. Upon release of the reset lever, return spring 36 shown in FIG. 1 returns the reset lever to its normal position. The test function is performed by pulling upwardly on the reset lever to cause cam 32*d* at the lower end of arm 32*a* of the reset lever to move the bias spring and the trip link 28 shown in FIG. 1 to the right sufficiently to trip the switch as indicated by arrow T in FIG. 17.

Another functional position of the selector arm may be selected by rotating it so that detent ARS snaps into the slot in the upper wall of the base. In order to do this, the reset lever must first be depressed part way down so that when selector arm 38 is rotated counterclockwise, cam 38*a* thereof will enter above shoulder 32*n* shown in FIGS. 3 and 4. As a result, cam 38*a* prevents the reset lever from being restored into its uppermost position and will assume the position shown in FIG. 1 with return spring 36 partly depressed. This presets the switch for the autoreset-stop function illustrated in FIG. 16. It will be apparent in FIG. 16 that reset bump 32*h* of the reset lever is held in its down position by the selector arm cam 38*a* so that whenever the trip link trips flipper blade 20, as soon as the trip force is relieved, bump 32*h* automatically resets the contacts. This state of the switch is indcated by arrow R in FIG. 16. Also in this state of the switch, the trip lever can be depressed further down for the stop function depicted by arrow S in FIG. 16. For this purpose, lug 32*k* of the trip lever engages the upper rounded corner of flipper cap 26 to open normally-closed contacts 18 but not closing normally-open alarm contacts 22 as described in connection with FIG. 15. However, because cam 38*a* of the selector arm holds the reset lever in an intermediate depressed position, the reset lever cannot be lifted upwardly to perform the test function illustrated in FIG. 17.

The third selected position can be attained by rotating selector arm 38 counterclockwise so that detent RT thereof snaps into the slot in the upper wall of the base. In this position, cam 38*a* of the selector arm clears shoulder 32*n* shown in FIG. 4 and enters below stop 32*p* of the reset lever shown in FIGS. 2–4 thereby to allow the reset lever to be depressed to an intermediate position for resetting the switch but preventing the reset lever from being depressed all the way down to the "stop" position. As a result, lug 32*k* cannot engage flipper cap 26 to open the contacts for the stop function in this selected position of the selector arm. However, both the reset function as depicted by arrow R in FIG. 14 and the test function as depicted by arrow T in FIG. 17 can be performed by depressing the reset lever to an intermediate position to reset the switch and lifting the reset lever upwardly to test the operation of the switch.

It will be apparent that in the aforementioned autoreset position of selector arm 38, bump 32*h* of the reset arm does not permit the flipper blade to buckle completely through after tripping and thus returns the switch automatically to the normal state when the tripping load is removed. For the test function, cam 32*d* engages the right angle portion 30*d* of the bias spring in the FIG. 1 version of bias spring to trip the switch for test purposes. With the FIG. 17 version of bias spring 40, cam 32*d* of the reset lever must be redesigned so that it will engage spring 40 itself and force it to the right to trip the switch.

While the apparatus hereinbefore described is effectively adapted to fulfill the objects stated, it is to be understood that the invention is not intended to be confined to the particular preferred embodiment of constant load snap switch with manual or automatic reset, stop and test selection disclosed, inasmuch as it is susceptible of various modifications without departing from the scope of the appended claims.

We claim:

1. A constant load snap-action switch comprising:

an insulating housing;

normally-closed contacts in said housing comprising a stationary contact and a movable contact operable to open and closed states with respect to said stationary contact;

external terminals;

means connecting said stationary contact to one of said external terminals;

a snap-action flipper blade in said housing connecting said movable contact to another one of said external terminals and being operable in response to a force applied thereto for causing snap-action tripping of said movable contact at the trip point of said flipper blade from said normally-closed state to said open state;

trip means mounted to said housing and operable through a trip stroke to transmit a trip force to said flipper blade comprising:

means for maintaining the required trip force applied through said trip means substantially constant through a significant portion of said trip stroke to said trip point comprising:

a bias spring mounted in said housing for applying a bias force to said flipper blade which decreases with the trip stroke such that the required trip force remains substantially constant through a significant portion of said trip stroke.

2. The constant load snap-action switch claimed in claim 1, wherein:

said means for maintaining the required trip force substantially constant also comprises;

means for adjusting the bias applied by said bias spring to said trip member.

3. A constant load and constant contact force snap-action switch comprising;

an insulating housing;

contacts in said housing comprising a stationary contact and a movable normally-closed contact operable to open and closed states with respect to said stationary contact;

external terminals;

means connecting said stationary contact to one of said external terminals;

a snap-action flipper blade in said housing connecting said movable contact to another one of said external terminals and being operable in response to a force applied thereto for causing snap-action tripping of said movable contact at the trip point of said flipper blade from said normally-closed state to said open state;

trip means comprising a trip member extending into said housing and operable through a trip stroke to apply a trip force to said flipper blade comprising:

means for maintaining said trip force and the contact force substantially constant through a significant portion of said trip stroke to said toggle point comprising:

a bias spring mounted in said housing for applying a bias force to said flipper blade which decreases with the trip stroke such that the required trip force transmitted through said trip member remains substantially constant through a large portion of said trip stroke and the contact force between said movable contact and said stationary contact also remains substantially constant until reaching said trip point.

4. The constant load and constant contact force snap-action switch claimed in claim 3, wherein said snap-action flipper blade comprises:

a pair of elongated tension members and an elongated compression member joined to each other at both ends and said blade being mounted at its lower end to said other external terminal and mounting said movable contact at its upper end such that when said trip force is applied forwardly below the center point of said compression member, said compression member flexes through an S-curvature to a reverse buckled state to snap said movable contact end thereof in the reverse direction to said open contacts state;

and the mechanical moment of said compression member and said trip force maintaining the contact force between said movable and stationary contacts substantially constant until reaching said trip point.

5. The constant load and constant contact force snap-action switch claimed in claim 4, wherein:

said switch also comprises a reset lever;

a return spring biasing said reset lever into its normal position;

means in said housing mounting said reset lever for limited sliding movement substantially parallel to said flipper blade;

and said reset lever comprising a reset element responsive to movement thereof in a first direction from said normal position against the force of said return spring to a first position for applying a reverse force to said reverse buckled compression member to restore the same from said reverse buckled state to a forward buckled state thereby to manually reset said contacts.

6. The constant load and constant contact force snap-action switch claimed in claim 5, wherein:

said contacts in said housing also comprise a second stationary contact and a normally-open movable contact constituting alarm contacts;

means connecting said second stationary contact to a third external terminal;

a leaf spring connecting said normally-open movable alarm contact to a fourth external terminal and insulating means coupling said leaf spring to said snap-action flipper blade so that when said flipper blade trips said normally-closed contacts open, it also acts through said insulating means to drive said alarm contacts closed.

7. the constant load and constant contact force snap-action switch claimed in claim 6, wherein:

said insulating means provides a lost motion coupling of said leaf spring to said flipper blade so that when said flipper blade is reset by said reset lever, said lost motion coupling provides an impact on said leaf spring to insure opening of said alarm contacts.

8. The constant load and constant contact force snap-action switch claimed in claim 5, wherein:

said reset lever also comprises means responsive to further movement thereof in said first direction against the force of said return spring beyond said first position to a second position for causing actuation of said contacts open so as to perform a stop function.

9. The constant load and constant contact force snap-action switch claimed in claim 8 wherein:

said reset lever also comprises test means responsive to movement thereof in a second direction against the force of said return spring to a third position for actuating said trip means thereby to trip said contacts open for test purposes.

10. The constant load and constant contact force snap-action switch claimed in claim 9, wherein:

said switch also comprises a selector member having a portion extending through said housing for actuation into any one of a plurality of selected positions;

and first cooperating means on said selector member and on said reset lever effective in a first selected position for preventing said further movement of said reset lever beyond said first position to said second position thereby to select only reset and test functions for said switch.

11. The constant load and constant contact force snap-action switch claimed in claim 10, wherein:

said switch also comprises second cooperating means on said selector member and on said reset lever effective in a second selected position for locking said reset lever from returning under the force of said return spring from said first position back to said normal position thereby to select only automatic reset and stop functions for said switch.

12. The constant load and constant contact force snap-action switch claimed in claim 11, wherein:

said switch further comprises third cooperating means on said selector member and on said reset lever effective in a third selected position for maintaining said reset lever clear of said selector member thereby to select manual reset and stop and test functions for said switch.

13. The constant load and constant contact force snap-action switch claimed in claim 9, wherein:

said test means comprises a cam on said reset lever that engages said bias spring to drive said compression member thereby to trip said contacts open for test purposes.

14. The constant load and constant contact force snap-action switch claimed in claim 13 wherein:

said housing comprises channels for guiding said reset lever for accurate movement of said cam for said test purposes and also for accurate movement of said reset element for reset purposes.

15. The constant load and constant contact force snap-action switch claimed in claim 14, wherein:

said housing comprises a pocket;

said return spring being in said pocket;

and means on said reset lever engaging said spring to return said lever to normal position after either said forward or reverse actuation.

* * * * *